US012722749B2

(12) United States Patent
Werner et al.

(10) Patent No.: US 12,722,749 B2
(45) Date of Patent: Sep. 1, 2026

(54) MODULAR HYDROFOIL WATERCRAFT

(71) Applicant: Ride Awake ApS, Copenhagen (DK)

(72) Inventors: Philip Werner, Stockholm (SE); Erik Tillberg, Stockholm (SE); Tais Clausen, Klagshamn (SE); Jordan Spack, Stockholm (SE)

(73) Assignee: Ride Awake ApS, Copenhagen (DK)

( * ) Notice: Subject to any disclaimer, the term of this patent is extended or adjusted under 35 U.S.C. 154(b) by 704 days.

(21) Appl. No.: 18/146,652

(22) Filed: Dec. 27, 2022

(65) Prior Publication Data

US 2023/0202621 A1 Jun. 29, 2023

(30) Foreign Application Priority Data

Dec. 29, 2021 (SE) ..... 2151635-6

(51) Int. Cl.
*B63B 32/53* (2020.01)
*B63B 32/10* (2020.01)
*B63B 32/64* (2020.01)

(52) U.S. Cl.
CPC ..... *B63B 32/53* (2020.02); *B63B 32/10* (2020.02); *B63B 32/64* (2020.02)

(58) Field of Classification Search
None
See application file for complete search history.

(56) References Cited

U.S. PATENT DOCUMENTS

| | | | | |
|---|---|---|---|---|
| 4,398,485 | A * | 8/1983 | Diziere | B63B 32/66 441/79 |
| 10,647,392 | B2 * | 5/2020 | Trewern | B63B 32/10 |
| 11,091,232 | B1 | 8/2021 | Montague et al. | |
| 11,383,797 | B2 * | 7/2022 | Werner | B63B 32/10 |
| 11,685,481 | B2 * | 6/2023 | Missler | B63B 32/60 114/55.54 |
| 11,897,583 | B2 * | 2/2024 | Montague | G08C 17/02 |
| 2015/0104985 | A1 | 4/2015 | Langelaan | |
| 2019/0161148 | A1 | 5/2019 | Trewern | |
| 2021/0024178 | A1 | 1/2021 | Weisenburger | |
| 2021/0114695 | A1 | 4/2021 | Weisenburger et al. | |
| 2021/0206456 | A1 * | 7/2021 | Werner | B63B 32/50 |
| 2021/0276669 | A1 | 9/2021 | Lyon et al. | |
| 2021/0347441 | A1 | 11/2021 | Lyon et al. | |
| 2021/0371053 | A1 | 12/2021 | Werner | |
| 2021/0371054 | A1 | 12/2021 | Montague et al. | |
| 2022/0204138 | A1 | 6/2022 | Montague et al. | |
| 2022/0274673 | A1 * | 9/2022 | Zhu | B60L 53/80 |

(Continued)

FOREIGN PATENT DOCUMENTS

| | | | |
|---|---|---|---|
| CN | 110844006 | A | 2/2020 |
| CN | 112467274 | A | 3/2021 |
| DE | 202022103928 | U1 | 9/2022 |

(Continued)

*Primary Examiner* — Kayla McCaffrey
(74) *Attorney, Agent, or Firm* — Capitol City TechLaw

(57) ABSTRACT

A modular hydrofoil watercraft may include a plurality of modules which are releasably connectable to each other to when assembled form the modular hydrofoil watercraft. The modular hydrofoil watercraft when assembled may include a hull extending along a longitudinal center axis, a propulsion system that has a motor and a propelling member, a mast that extends downwardly from the hull and a hydrofoil connected to the mast.

13 Claims, 5 Drawing Sheets

(56) References Cited

U.S. PATENT DOCUMENTS

| | | | | |
|---|---|---|---|---|
| 2023/0140898 | A1* | 5/2023 | Montague | H02K 5/132 440/6 |
| 2024/0010307 | A1* | 1/2024 | Bitterolf | B63B 32/66 |

FOREIGN PATENT DOCUMENTS

| | | | |
|---|---|---|---|
| FR | 3078680 | A1 | 9/2019 |
| WO | 2020242146 | A1 | 12/2020 |
| WO | 2021216912 | A1 | 10/2021 |
| WO | 2022037809 | A1 | 2/2022 |

* cited by examiner

MODULAR HYDROFOIL WATERCRAFT

This application claims priority under 35 USC 119(a)-(d) from Swedish Application No. 2151635-6 filed on Dec. 29, 2021, the entire contents of which are incorporated herein by reference.

BACKGROUND

1. Technical Field

Present invention relates to a modular hydrofoil watercraft. In particular, the invention relates to a motorized modular hydrofoil watercraft.

2. Discussion of Related Art

Hydrofoil watercrafts such as hydrofoil boards are sometimes preferred to conventional motorized surfboards, jetskis etc. due to their stability which allows the user to have a more relaxed experience even at high speeds. Hydrofoil watercrafts commonly have a hull body provided with a hydrofoil. The hydrofoil is mounted to a mast extending into the water during operation of the watercraft. Further, a propulsion system is commonly mounted to the mast. The positioning of the propulsion system causes the hull body to raise above the water upon the watercraft exceeding a certain speed. Once risen, the watercraft is kept stable due to the mast. Furthermore, due to the hull body not being in contact with the water, the drag is reduced allowing for the watercraft to reach high speeds. In order to keep the watercraft stable, the hydrofoil is usually provided with fins and wings.

Due to their design, hydrofoil watercrafts becomes bulky and difficult to transport. To solve this, modular hydrofoil watercrafts have been implemented in the past. However, these often require screws and tools in order to assemble and disassemble. Furthermore, due to the high speeds which the watercraft is required to operate, the connections between the components of the watercraft may be subject to high loads as well as wear and tear. In addition, the connections may also introduce instability in the watercraft during operation due to the components not being sufficiently retained relative to each other.

The present inventors have realized that there is room for improvements within this field.

SUMMARY

According to an aspect, a modular hydrofoil watercraft is provided. The modular hydrofoil watercraft comprises a plurality of modules which are releasably connectable to each other to when the assembled form said modular hydrofoil watercraft. The modular hydrofoil watercraft when assembled comprises a hull. The hull extends along a longitudinal center axis. The modular hydrofoil watercraft when assembled further comprises a propulsion system. The propulsion system comprises a motor and a propelling member. The motor is in driving connection with the propelling member. The modular hydrofoil watercraft when assembled comprises a mast adapted to extend downwardly from the hull. The propelling member is connected to the mast. The modular hydrofoil watercraft when assembled further comprises a hydrofoil connected to the mast.

The plurality of modules comprises at least a first module and second module. The first and second module are releasably connectable to each other.

The modular hydrofoil watercraft further comprises one or more locking arrangements. A locking arrangement of the one or more locking arrangements is arranged to releasably retain the first module and the second module of the plurality of modules in connection.

Further objects and features of the present invention will appear from the following detailed description of embodiments of the invention.

BRIEF DESCRIPTION OF DRAWINGS

The invention will be described with reference to accompanying drawings, in which.

DETAILED DESCRIPTION OF NON-LIMITING EMBODIMENTS

Figure 1:
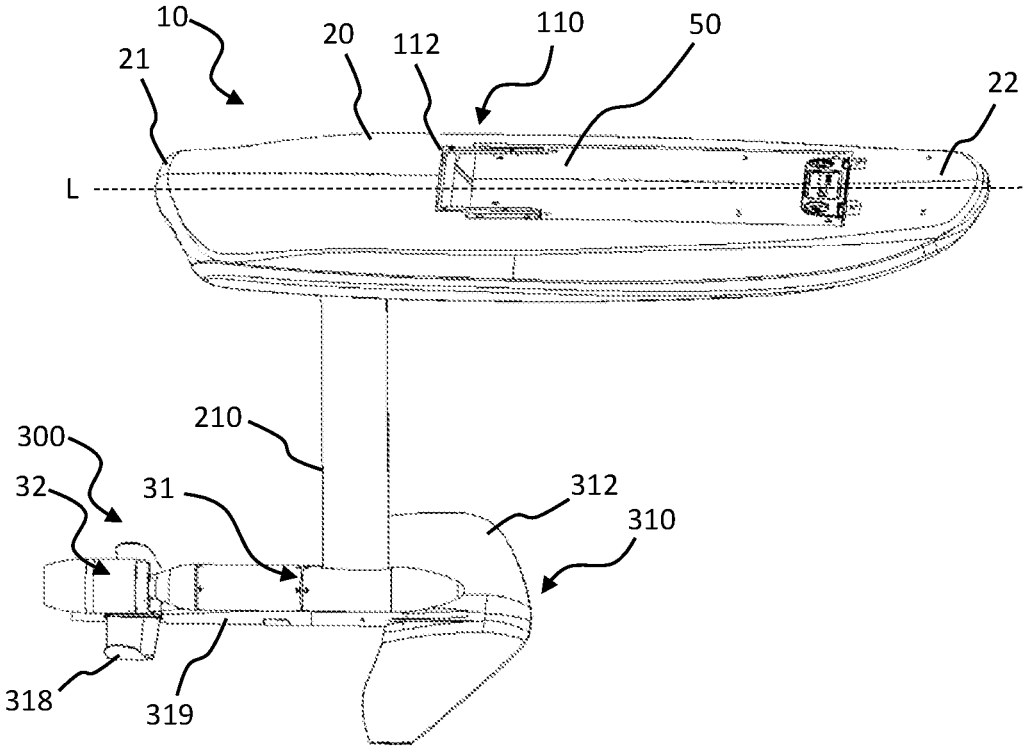
FIG. 1 depicts a side view of a modular hydrofoil watercraft according to a first embodiment.
Figure 2:
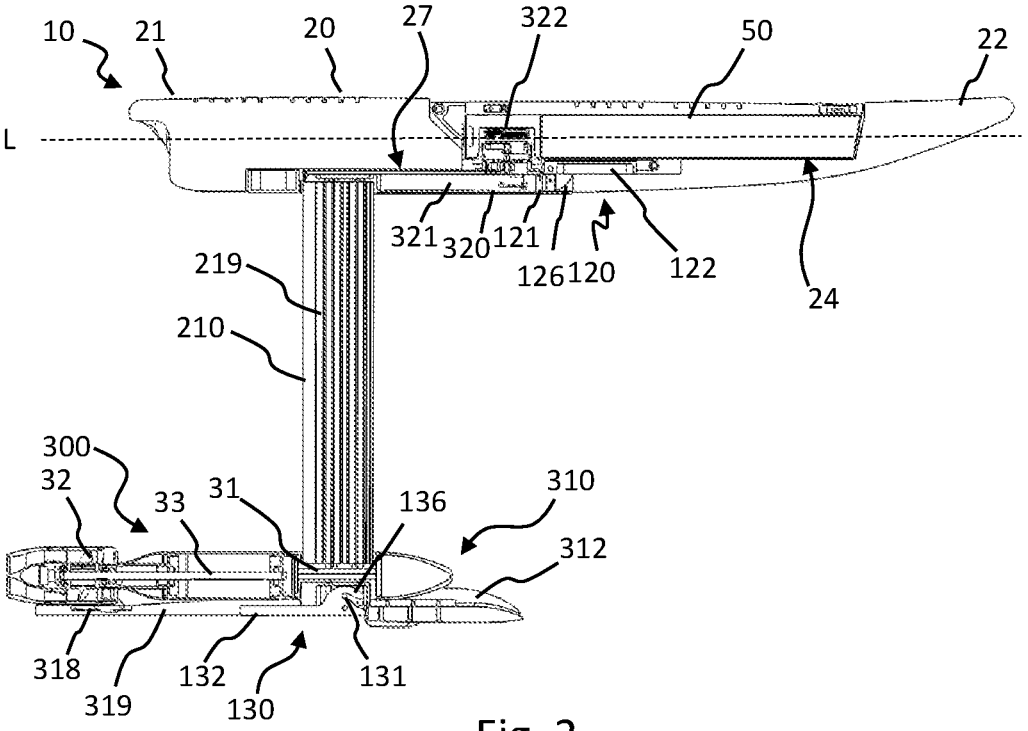
FIG. 2 depicts a cross section view of the modular watercraft according to the first embodiment.
Figure 3:
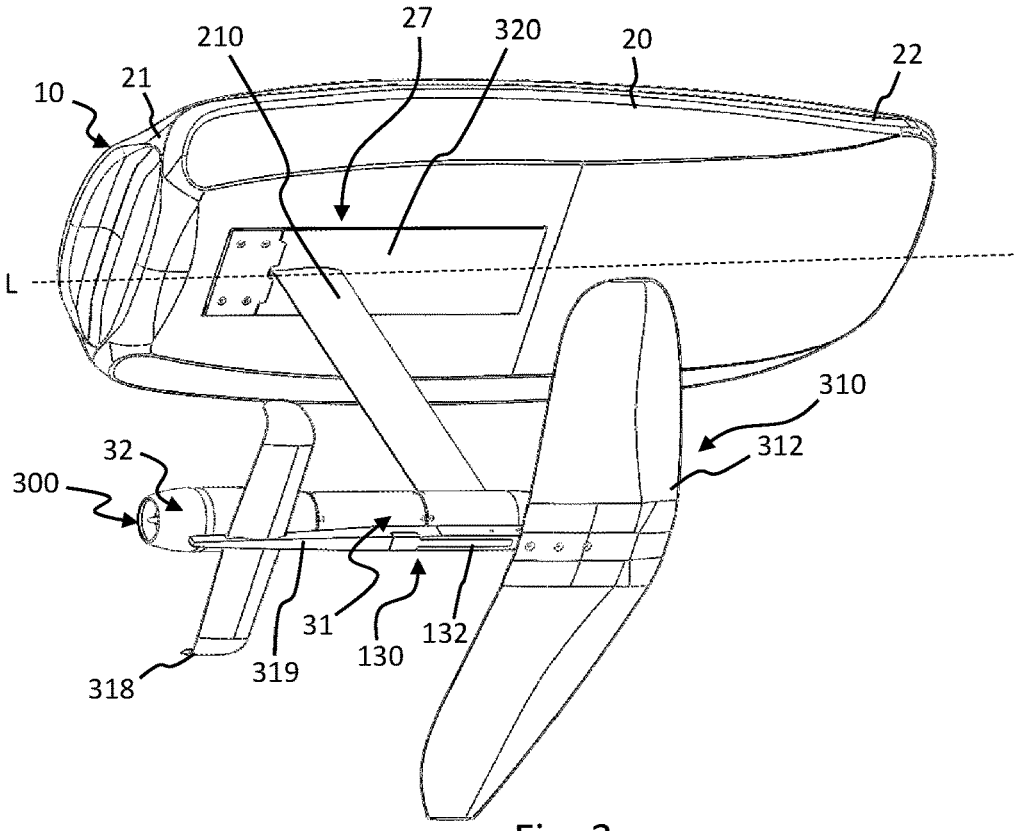
FIG. 3 depicts a bottom perspective view of the modular watercraft according to the first embodiment.

The invention will now be explained with reference to the accompanying drawings. FIGS. 1 to 5 depicts a first embodiment of a watercraft according to the invention and FIGS. 6 to 9 depicts a second embodiment of watercraft according to the invention.

A modular hydrofoil watercraft 10 is depicted. The modular hydrofoil watercraft 10 comprises a plurality of modules. The modules are releasably connectable to each other. The modules are releasably connected to each other such that when said modules are assembled, i.e. connected to each other, they form the modular hydrofoil watercraft 10. Thus, the modules may be releasably couplable to each other. The modules may be releasably and mechanically connectable.

The watercraft 10 comprises a hull 20. The hull 20 may be in the form of a board. The hull 20 may be an elongated hull. The hull 20 may be comprised in a hull module. The hull module 20 may be fluid tight or waterproof. In this particular embodiment the hull 20 is in the form of a board, the board is in itself buoyant on its own merit and may comprise an empty shell-type hull. The hull 20 may be considered a floating body. The watercraft may be suitable for personal transport or leisure. For example, a user may stand on the board or lay down on the board during operation. In a further example, the user may lay down on the board and control the watercraft by operating a remote control unit. The modular hydrofoil watercraft may be adapted to only be maneuvered in longitudinal and latitudinal direction by means of the weight distribution of a user positioned on a top surface of the board. The modular hydrofoil watercraft may be adapted to only allow for turning relative a travelling direction of the watercraft in response to changes in weight distribution of a user positioned on a top surface of the board. The modular hydrofoil watercraft may thus solely comprise stationary surfaces, i.e. no rotatably arranged rudders or propellers etc. allowing for turning of the watercraft.

The hull may be in the form of a board such as a wakeboard, surfboard, standup paddle board bodyboard/kneeboard or a jet ski/water scooter or boat.

The hull 20 has a front end 22 and a rear end 21 with the hull extending there between. The hull 20 may extend along a longitudinal center axis L. The longitudinal center axis L is arranged along the length-wise center of the hull 20.

The watercraft 10 further comprises a propulsion system 300. The propulsion system 300 is configured to drive the watercraft 10. The propulsion system may comprise a motor 31 and a propelling member 32. The motor 31 is in driving connection with the propelling member 32. Accordingly, the motor 31 is arranged to drive the propelling member 32 for propelling the watercraft 10.

The modular hydrofoil watercraft is thus a motorized modular hydrofoil watercraft. A motorized watercraft is herein referred to as a watercraft with a propulsion system, i.e. a motor driven watercraft.

In one embodiment, the motor 31 may be a combustion engine. The modular hydrofoil watercraft may thus comprise a fuel tank and fuel supply lines for providing fuel to the motor 31.

In one embodiment, which is depicted in FIG. 1, the propulsion system 300 may be electrically driven. The modular hydrofoil watercraft may thus be an electrical modular hydrofoil watercraft. The modular hydrofoil watercraft 10 may thus comprise an electric power unit 50 for powering the propulsion system 300. The electric power unit 50 may further be configured for powering and/or driving the motor 31. The electric power unit 50 may comprise one or more batteries for powering the propulsion system 300.

Further referencing FIG. 1, the hull 20 comprises means for receiving the electric power unit 50 here in the form of an electric power unit compartment 24, facilitating that an electric power unit 50 is safely received and retained in the hull 20 without risk of dislodging during operation of the modular hydrofoil watercraft 10. The electric power unit compartment 24 is thus adapted to receive the electric power unit 50. The electric power unit 50 may comprise a shape corresponding to an external surface, such as the top-part of the hull module and thus become flush with edges of the hull 20 and/or electric power unit compartment 24 upon attachment to the hull 20/electric power unit compartment 24. The electric power unit compartment 24 may thus be provided in a top surface of the hull 20.

The propulsion system 300 comprises at least one motor 31 in driving connection with at least one propelling member 32 via at least one drive shaft 33. The motor 31 may be comprised in a motor unit which also may comprise power electronics. The propelling member 32 may for example comprise one or more propellers. The propulsion system may comprise casing or pods surrounding the propelling member. In one embodiment, the propelling member 32 may be arranged in a propelling member pod. In one embodiment, the motor 31 may be arranged in a motor pod. The motor pod and/or the propelling member pod may be arranged to form an additional lifting surface or bearing plane for the modular hydrofoil watercraft. Said additional lifting surface or bearing plane may be parallel to the lifting surface or bearing plane formed by the hydrofoil. In one embodiment, the additional lifting surface or bearing plane may coincide with the lifting surface or bearing plane formed by the hydrofoil.

The watercraft may further comprise a control unit 321. The control unit 321 is operatively coupled to the motor 31. The control unit 321 is configured to control the motor 31. In one embodiment, the control unit 321 may comprise an electronic speed controller ESC. The electronic speed controller ESC is configured to control the speed of the motor 31.

Data communication between the various components of the watercraft via the control unit 321 may be made by CAN (Controller Area Network). Data communication may also be made using other wired or wireless data connections known in the art.

The control unit 321 may comprise one or more processors, a memory, and an input/output (I/O). The memory may store a software program in the form of code that is executable by the processor. Input information may be received by an I/O module. The input information may include information from the sensors provided in the watercraft and/or operational components relating to the condition and/or operation of the watercraft as a whole. The input information may also include information input by a user. Based on the input information, the control unit 321 can control operation of the watercraft. Specifically, the software program stored in the memory is operable to use the input information to determine operating instructions for the propulsion system 300. For example, operating instructions may be provided to the ESC which controls the speed of the motor 31. The memory may further store information received from the sensors and/or operational components, or from other components of the watercraft.

In the depicted embodiment, the propulsion system is a jet propulsion system. The propulsion system 300 may thus comprise a water jet arrangement. The propelling member 32 may thus be in the form of a water jet unit comprising an impeller. The impeller is coupled to the motor 31 by means of the drive shaft 33. The water jet arrangement may accordingly comprise the water jet unit.

The propulsion system 300 may be capable of operating independently the hull 20. Thus, the propulsion system 300 is, when assembled, fully water proof. This feature has the advantage that it can operate externally from the hull 20 during operation of the watercraft 10 such that no electrical components, or no components essential for the basic function of the watercraft has to be integrated in the hull. Thus, the hull 20 may comprise only a dead shell.

The propulsion system 300 may be at least partially comprised and preferably comprised in a drive module. The drive module may comprise the propelling member 32 and the motor 31. The electric power unit 50 may thus be configured to power the drive module. The motor 31 is typically installed in a waterproof container or casing of the drive module. Further, the drive module may comprise the drive shaft 33.

Substantially the entire drive module is submerged in a surrounding fluid during operation of the modular hydrofoil watercraft 10. In the depicted examples, the drive module comprises the water jet unit comprising at least one impeller in driving connection with a motor 31 of the drive module 30 via the drive shaft 33. The motor 31, the drive shaft 33 and the water jet unit are preferably arranged along a straight direction, which may extend parallel and/or along the longitudinal center axis L.

The modular hydrofoil watercraft 10 further comprises a mast 210. The mast 210 is adapted to extend downwardly from the hull 20. The propelling member 32 is connected to the mast 210. The propelling member 32 may be directly or indirectly connected to the mast 210. The propelling member 32 may be attached to the mast 210. The mast 210 may be in the form an elongated member. The elongated member extends substantially orthogonal to the longitudinal center axis L. The mast 210 may be arranged at a position of the hull 20 proximal to the rear 21 of the hull 20. The mast 210 may be arranged at a position of the hull 20 disposed along the longitudinal center axis L. The mast 210 may extend from a bottom surface of the hull 20.

The modular hydrofoil watercraft 10 further comprises a hydrofoil 310. The hydrofoil 310 is connected to the mast 210. The hydrofoil 310 may be directly or indirectly connected to the mast 210. The hydrofoil 310 may be attached to the mast 210. In one embodiment, the hydrofoil 310 may be connected to the mast 210 via the propulsion system 300 or vice versa.

Although the depicted embodiments only shows a single mast, it is within the scope of this disclosure that the watercraft may comprise one or more masts. For example, the watercraft may comprise two or more masts connected to a single hydrofoil or two or more masts each being connected to a hydrofoil.

The hydrofoil 310 may be arranged at a bottom end of the mast 210. The hydrofoil 310 forms a fuselage. The fuselage is arranged at the bottom end of the mast 210. As the skilled person is aware, the hydrofoil 310 is adapted to form a lifting surface or bearing plane for the modular hydrofoil watercraft. Thus, the hydrofoil 310 is a structure arranged below the hull adapted to provide a lifting surface for the modular watercraft. The hydrofoil 310, and the fuselage of the hydrofoil 310, extends parallel and preferably along to the longitudinal center axis L of the hull 20.

As depicted, the hydrofoil 310 may comprise at least one wing 312, 318. The at least one wing 312, 318 is adapted to guide water flow around the hydrofoil 310.

The hydrofoil 310 may comprise a front wing 312. The front wing 312 is arranged at a front end of the hydrofoil 310. The front end is a front end relative to a direction extending parallel to the longitudinal center axis L from the rear 21 to the front 22 of the hull 20. The hydrofoil 310 may comprise a tail wing 318. The tail wing 318 is arranged at a rear end of the hydrofoil 310. The rear end is a rear end relative to a direction extending parallel to the longitudinal center axis L from the rear 21 to the front 22 of the hull 20. In other words, the front and rear end may be a front end and rear end relative to the travelling direction of the modular hydrofoil watercraft.

The hydrofoil 310 may further comprise a strut 319. The strut 319 may be attached to the mast 210. The tail wing 318 and/or front wing 312 may each be mounted to the strut 319.

Preferably, the at least one wing 312, 318 and the strut 319 may each extend in the same plane, i.e. a plane in which the lifting surface formed by the hydrofoil extends. The plane may be considered a bearing plane. The at least one wing 312, 318 may extend orthogonally to the strut 319 and/or the direction of the hydrofoil. The at least one wing 312, 318 may extend orthogonally from opposite longitudinal sides of the strut 319.

According to the invention, the hull 20, the mast 210 and the propulsion system 300 are comprised in modules. The modules are connected to at least partly form the modular hydrofoil watercraft 10. Modules herein refers to sub-assemblies of components forming the watercraft. The modules are releasably connectable to form the watercraft. Accordingly, the plurality of modules are adapted to when connected comprise the hull, the propulsion system, the mast and the hydrofoil. The plurality of modules may be adapted to, when connected, form said hull, propulsion system, mast and hydrofoil.

Thus, the plurality of modules may comprise at least a first module and a second module being releasably connectable to each other.

The sub-assemblies may in some cases be independently operable, i.e. may not require connection to other assemblies in order to operate. The hull, the mast and the propulsion system may be disposed in two or more separate modules. The propulsion system may also be divided amongst two or more separate modules or be comprised in a single module.

In order to allow for easy assembling and disassembling of the watercraft, one or more locking arrangements 110, 120, 130 are provided. The modular hydrofoil watercraft 10 thus comprises one or more locking arrangements 110, 120, 130. Each locking arrangement is arranged to releasably retain a pair of releasably connected modules of the plurality of modules. The pair of releasably connected modules may be mechanically connected, e.g. mechanically coupled. Thus, the plurality of modules may comprise at least one pair of modules which are releasably connected to each other and releasably retained by means of a locking arrangement. In other words, a locking arrangement of the one or more locking arrangements is arranged to releasably retain a first module and a second module of the plurality of modules in connection, e.g. releasable mechanical connection. As will be exemplified with reference to the figures, the plurality of modules may comprise a plurality of pairs of releasably connected modules, at least some of which being retained in connection by means of a locking arrangement.

The locking arrangements may be hand-operable locking arrangements. The locking arrangements may accordingly not require tools to operate.

The modules and locking arrangements may be arranged in numerous ways. As the skilled person is aware, the connections between the modules and consequently the locking arrangements may be provided in different manners while still providing a similar assembled watercraft when said modules are connected. It is further noted that some modules may be connected without being secured in place by means of a locking arrangement.

Figure 4:
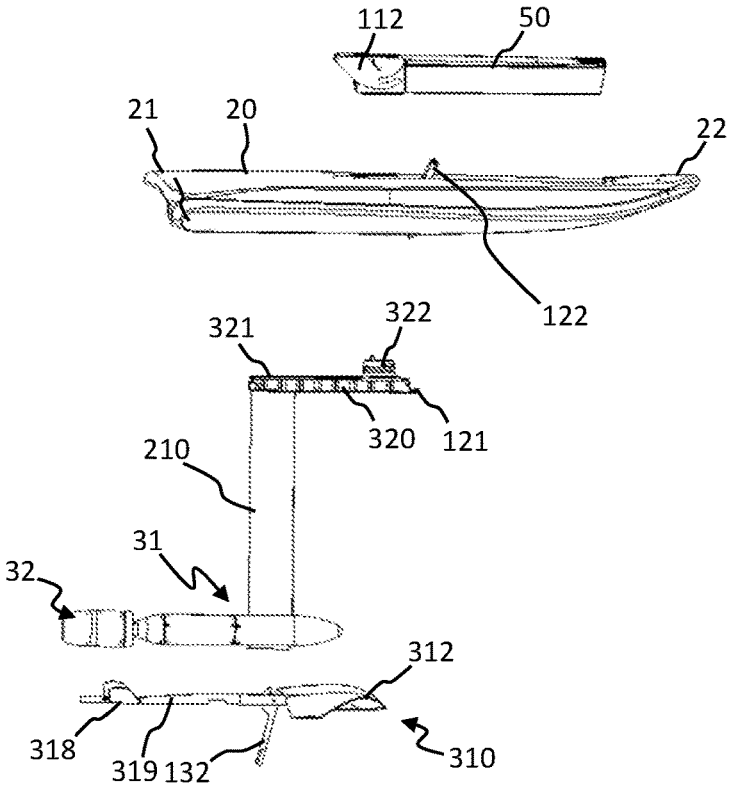
FIG. 4 depicts an exploded view of the modular watercraft according to the first embodiment.
Figure 5:
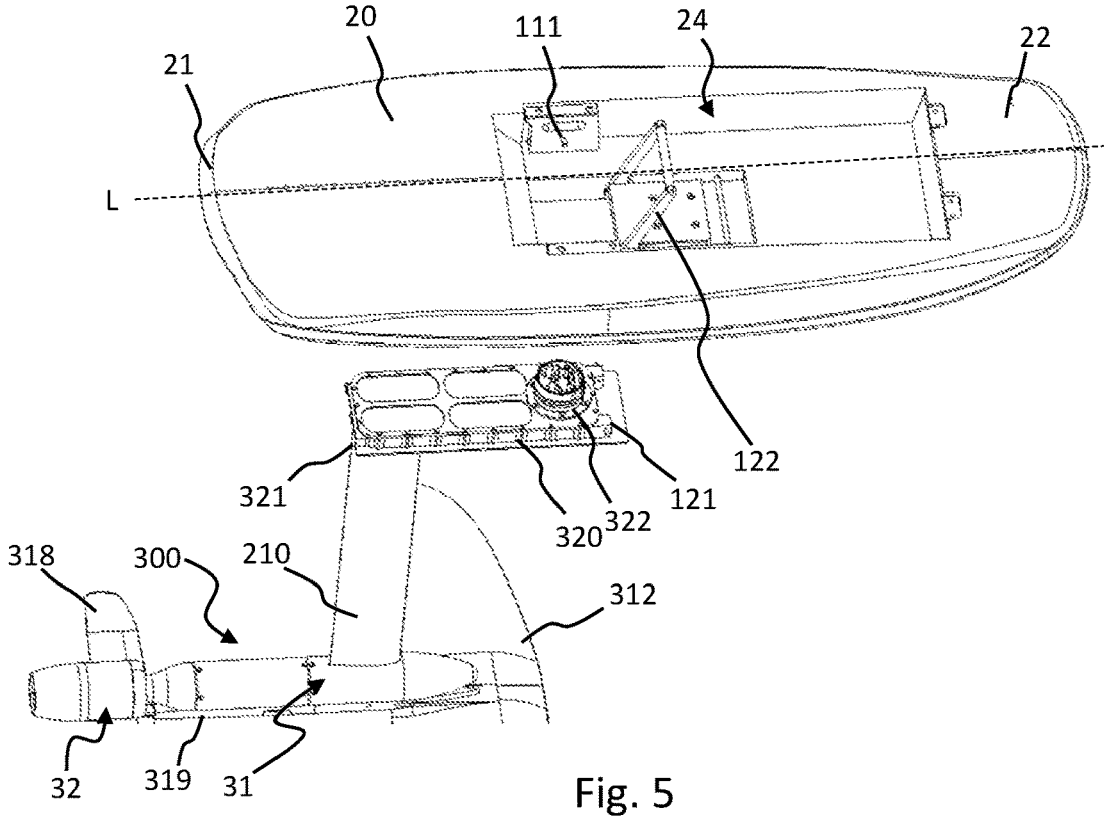
FIG. 5 depicts a top perspective exploded view of a modular hydrofoil watercraft according to the first embodiment.
Figure 6:
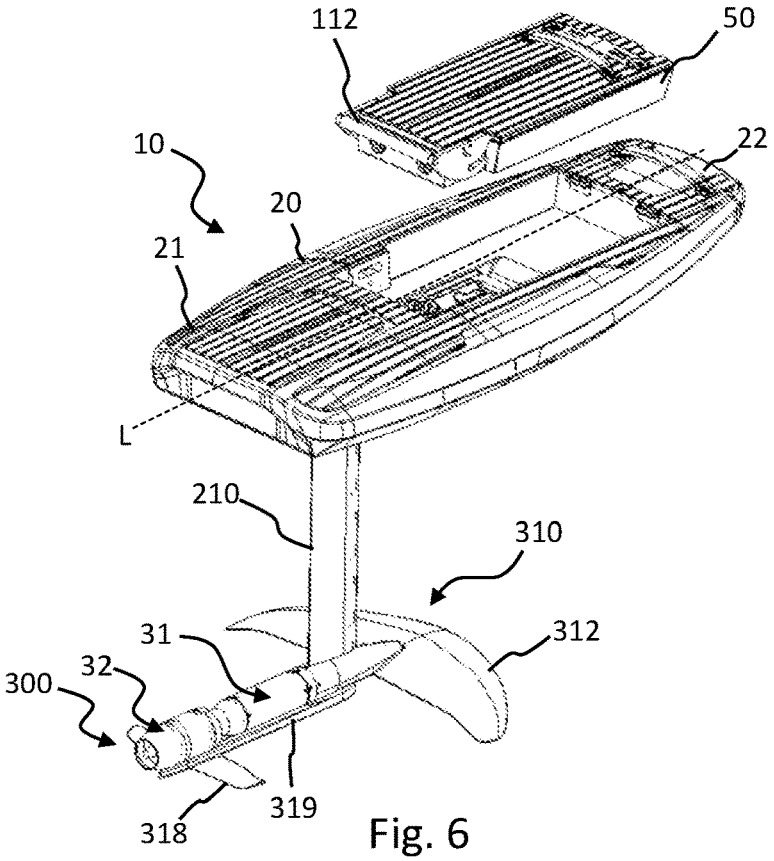
FIG. 6 depicts a perspective exploded view of the modular hydrofoil watercraft according to a second embodiment.
Figure 7:
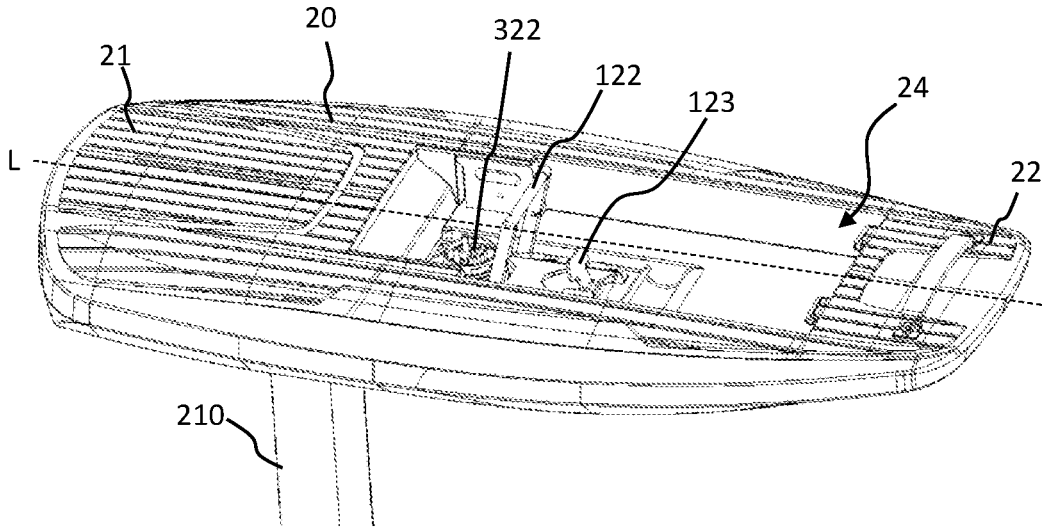
FIG. 7 depicts a top perspective view of a part of the modular hydrofoil watercraft according to the second embodiment.

FIG. 4 depicts an example of a composition of modules forming the modular hydrofoil watercraft.

The hull 20 is comprised in a hull module. The hull module may as previously explained comprise no components but the hull forming the floating body of the watercraft.

The plurality of modules further comprises an electric power module. The electric power module comprises the electric power unit 50. The electric power unit 50 is releasably connected to the hull module. The hull module and the electric power module thus forms a pair of releasably connected modules. Thus, the electric power module and the hull module may form a first and second module retained by means of a locking arrangement.

In the depicted example, the electric power unit 50/electric power module is releasably and mechanically connected to said hull module by means of insertion into a compartment, i.e. the electric power unit compartment 24, of said hull module. This allows for a more compact and efficient shape of the watercraft. It may however be envisioned that the electric power unit is mechanically mounted to a top or bottom surface of the hull module as well.

In the depicted embodiment, the mast 210, a connector part 320 for electrically connecting the propulsion system and the electric power unit 50 as well as the propulsion system 300 are comprised in a single module. The mast 210, connecting part 320 and the propulsion system 300 are connected. The mast 210, the connecting part 320 and the propulsion system 300 may be comprised in an operation module. This is particularly advantageous since it allows for a modular watercraft without the need for the user to electrically connect multiple modules. Instead, electric wiring may be provided from the connector part 320 via the mast 210 to the propulsion system 300 in a single module to be mounted to the watercraft.

It may be envisioned however that any one or each of said components are comprised in separate modules releasably connected to each other. Accordingly, the plurality of modules may comprise a drive module comprising the propulsion system 300 and a mast module comprising the mast 210. Further, the plurality of modules may comprise a connector module comprising the connector part. Said modules may be releasably and electrically connected as well as releasably and mechanically connected. Said modules may be releasably retained in connection by means of a locking arrangement. Said modules may also form sub-modules attached to each other to form the operation module. Accordingly, the operation module may comprise at least the drive module and the mast module in the form of connected sub-modules.

Further referencing FIG. 4, the hydrofoil 310 may be comprised in a hydrofoil module. The hydrofoil module may be releasably connected to the mast 210. In one embodiment, the hydrofoil module may be releasably connected to the operation module. The hydrofoil module may be mechanically and releasably connected to the mast 210 or operation module. The hydrofoil module and the operation module may thus form a first and second module retained by means of a locking arrangement. The hydrofoil module may only comprise the fuselage of the hydrofoil. Thus, the hydrofoil solely comprises the previously described wings and struts.

The hydrofoil module may be mechanically connected to the mast 210 by means of a sliding connection or a retaining/clamping engagement between said mast 210 and the hydrofoil module. The mechanical connection may be secured by means of a locking arrangement. This allows for the hydrofoil to be transported separately and be easily mounted to the watercraft, this is particularly advantageous due to the hydrofoil often being bulky.

In one embodiment, the operation module may comprise at least the mast module and the hydrofoil module in the form of connected sub-modules. In one embodiment, the operation module may comprise the mast module, the hydrofoil module and the drive module in the form of connected sub-modules.

The construction of the locking arrangements will now be explained with reference to FIGS. 1 to 5. Generally, it is noted that although particular modules are depicted as being retained by means of particular locking arrangements, any type of the exemplified locking arrangements may be utilized to retain any one of the depicted connected modules in connection.

In one embodiment, the locking arrangement 110, 120, 130 may comprise a locking element 112, 122, 132. The locking element 112, 122, 132 may be provided on one of the pair of releasably connected modules, i.e. a first module of the pair of modules. The locking arrangement 110, 120, 130 may further comprise a retention member 111, 121, 131. The retention member 111, 121, 131 is provided on the other module of the releasably connected pair of modules, i.e. a second module of the pair of modules. The locking element 111, 121, 131 is movable between a retaining position and a disengaged position. In the retaining position, the locking element 112, 122, 132 engages the retention member 111, 121, 132 and secures the first module to the second module. In the disengaged position, the locking element 112, 122, 132 is out of engagement with the retention member 111, 121, 131. In the disengaged position, the first module is releasable relative the second module. In other words, said first module is releasable from the connection with said second module.

In one embodiment, the locking element is in the form of a sliding member. The sliding member is translationally movable between the retaining position and the disengaged position. The locking arrangement may accordingly be in the form of a finger lock or pin lock.

In one embodiment, the locking element 112, 122, 132 is in the form a pivotable lock lever. The pivotable lock lever is thus pivotally movable between the retaining position and the disengaged position. In one embodiment, the pivotable lock lever may comprise a retention portion 126, 136. The retention portion 126, 136 may be adapted to engage the retention member 111, 121, 131 in the retaining position. The retention portion 126, 136 may be in the form of a latch or hook. The retention portion 126, 136 may be adapted to engage the retention member 111, 121, 131 in a retaining manner when the pivotable lock lever is in the retaining position. The retention member may be in the form of a pin, shoulder or recess adapted to receive the retention portion 126,136 in a retaining manner.

The pivotable lock lever may comprise a first and second end. The first end may be rotatably coupled to the first module. The first end may further comprise the retention portion 126, 136. The second, opposite, end may be an actuating end accessible for operation by a user.

To ensure stable connection between the connected modules, the locking element 112, 122, 132 may be adapted to exert a contact force on the second module by means of the retention member 111, 121, 131 pressing said second module against the first module.

The watercraft depicted in FIGS. 1 to 5 implements a plurality of locking arrangements.

The one or more locking arrangements may comprise an electric power unit locking arrangement 110. The electric power unit locking arrangement 110 is arranged to releasably retain the hull 20, e.g. the hull module, and the electric power unit 50, e.g. the electric power module, in connection. The hull 20, e.g. the hull module, may be provided with a retention member 111 and the electric power unit 50, e.g. the electric power module, may be provided with a locking element 112. The electric power unit locking arrangement 110 may be arranged proximal to the top surface of the watercraft (and the hull) to allow for user-friendly assembly.

As most clearly depicted in FIG. 4, the hydrofoil 310 may be comprised in a separate module, i.e. the previously described hydrofoil module. Thus, the hydrofoil 310, i.e. the hydrofoil module, may be releasably connected to the mast 210. The one or more locking arrangements may thus comprise a hydrofoil locking arrangement 130. The hydrofoil locking arrangement 130 is arranged to releasably retain the mast 210 and the hydrofoil 310 in connection. According to the depicted embodiment, the mast 210 is provided with a retention member 131 and the hydrofoil 310 is provided with a locking element 132. In the depicted embodiment, the mast 210 is comprised in the previously described operation module. Thus, the hydrofoil module may be releasably connected to said operation module. The hydrofoil locking arrangement 130 is thus arranged to releasably retain the hydrofoil module and the operation module in connection. According to the depicted embodiment, the operation module is provided with the retention member 131 and the hydrofoil module is provided with the locking element 132.

As previously explained, the modular hydrofoil watercraft 10 may comprise a connector part 320. The connector part 320 may form a connector module releasably connected to the mast 210. The connector part may be comprised in the operation module as a connector module in the form of a sub-module. The connector part 320 is connected to the mast 210. The connector part 320 may be releasably connected to the mast 210. In the depicted embodiment, the connector part 320 is attached to the mast 210. In the depicted embodiment, the connector part 320 is comprised in the operation module. The connector part 320 is releasably connectable to the hull 20, the operation module and the hull module may thus form a first and second module retained by means of a locking arrangement.

The connector part 320 comprises a connector 322. The connector 322 is releasably connected to the electric power unit 50. The electric power unit may comprise a corresponding connector adapted to together with the connector 322 form an electric connection between the electric power unit 50 and the connector part 320. The connectors may be adapted to provide a blind-mate connection such as a male to female connection. The connectors may be further configured to transfer data between the electric power unit 50 and the control unit 321 and/or propulsion system 300.

The connector part 320 is configured to operatively couple the propulsion system 300 and the electric power unit 50. The mast 210 may thus comprise wiring 219 connected to the connector part 320 and the propulsion system 300, e.g. the motor 31 of the propulsion system 300. The wiring may be electric wiring. The wiring may be configured to transfer data and/or power. Alternatively, any conventional wireless communication mean for data may be utilized for the data transfer.

Preferably, the control unit 321 is arranged in the connector part 321. The control unit 321 may be electrically connected to the electric power unit 50 via the connector 322. The control unit 321 may be electrically connected to the connector 322. The control unit 321 may be operatively coupled to the propulsion system 300 by means of the wiring 219.

In one embodiment, the watercraft may comprise connection sensing means. The connection sensing means are operatively coupled to the control unit 321. The connection sensing means are configured to detect connection between the connector 322 and the electric power unit 50. The connection sensing means may comprise at least one sensor. The at least one sensor is configured to detect said connection. In one embodiment, one of the connectors may be provided with a magnet and the other with a sensor configured to detect said magnet to detect connection between said connectors. In one embodiment, at least one of the connectors may be provided with a voltage or current sensor configured to detect connection by means of detecting a current or voltage over said connector.

In one embodiment, the connector part 320 is releasably connected to the hull 20, e.g. the hull module 20. The connection may be releasably retained by means of a locking arrangement. Thus, the one or more locking arrangement may comprise a connector locking arrangement 120. The connector locking arrangement 120 is arranged to releasably retain the hull 20 and the connector part 320 in connection.

In one embodiment, the hull 20 comprises a connector compartment 27. The connector compartment 27 is adapted to receive the connector part 320. In one embodiment, the connector part 320 is releasably and mechanically connected to the hull 20 by means of insertion in said connector compartment 27.

The connector compartment 27 may be arranged at a bottom surface of the hull 20. The connector compartment 27 thus faces the mast 210.

In one embodiment, the connector locking arrangement 120 may be arranged to be accessible from a top surface of the hull 20. Thereby, the assembling of the watercraft is easier due to the user not having to turn the watercraft upside-down in order to retain the connector part to the hull. Furthermore, it allows for easy assembling of the watercraft in the water, i.e. when the hull is floating on the water surface.

The connector locking arrangement 120 may be arranged to be accessible from the top surface of the hull 20 such that the connector locking arrangement 120 may be operated by a user from a position above the watercraft. Worded differently, the connector locking arrangement 120 may be arranged to face upwards from the hull 20. The connector locking arrangement may be arranged to face upwards from the hull 20 in a direction extending opposite to the mast 210.

The top surface may be opposite the bottom surface of the hull 20, e.g. the bottom surface from which the mast extends downwardly. The top surface may extend parallel to the longitudinal center axis L.

Thus, the connector locking arrangement 120 may be arranged at a top surface of the hull 20. The connector locking arrangement 120 may be provided at a top surface of the hull 20.

Preferably, the locking element 122 may be provided at the top surface of the hull 20. The locking element 122 may be accessible for operation by a user to cause movement between the retaining position and the disengaged position from a top surface of the hull 20, e.g. be operable by a user from a position above the watercraft 10. In one embodiment, the locking element 122 may be arranged to be substantially flush with the top surface of the hull 20 in the retaining position.

In one embodiment, the connector locking arrangement 120 may be provided at the upper surface of the hull 20 by being provided at a top portion of the hull 20. In one embodiment, the locking element 122 may be provided on the top portion of the hull 20. In one embodiment, the locking element 122 may be mounted to the top portion of the hull 20. According to such an embodiment, the retention member 121 may be provided on the connector part 320. In one embodiment, the retention member may be mounted to connector part 320.

Alternatively, the retention member 121 may be provided on the top portion of the hull 20 and the locking element 122 may be provided on an upper portion of the connector part 320.

In one embodiment, the connector locking arrangement 120 may be accessible from the electric power unit compartment 24. The electric power unit compartment 24 may form a portion of the top surface of the hull 20. The connector locking arrangement 120 may be accessible from the electric power unit compartment 24 when the electric power unit 50 is not arranged in the electric power unit compartment 24.

In one embodiment, the connector locking arrangement 120 may be provided at a surface of the electric power unit compartment 24. In one embodiment, said surface may extend substantially parallel to the longitudinal center axis L. Said surface may be arranged to face upwards from the hull 20. Said surface may be arranged to face upwards in a direction extending opposite to the mast 210.

Preferably, the locking element 122 may be provided at said surface of the electric power unit compartment 24. The locking element 122 may be accessible for operation by a user to cause movement between the retaining position and the disengaged position from a top surface of the hull 20, e.g. be operable by a user from a position above the watercraft 10. In one embodiment, the locking element 122 may be arranged to be substantially flush with said surface of the electric power unit compartment 24 in the retaining position.

Figure 9:
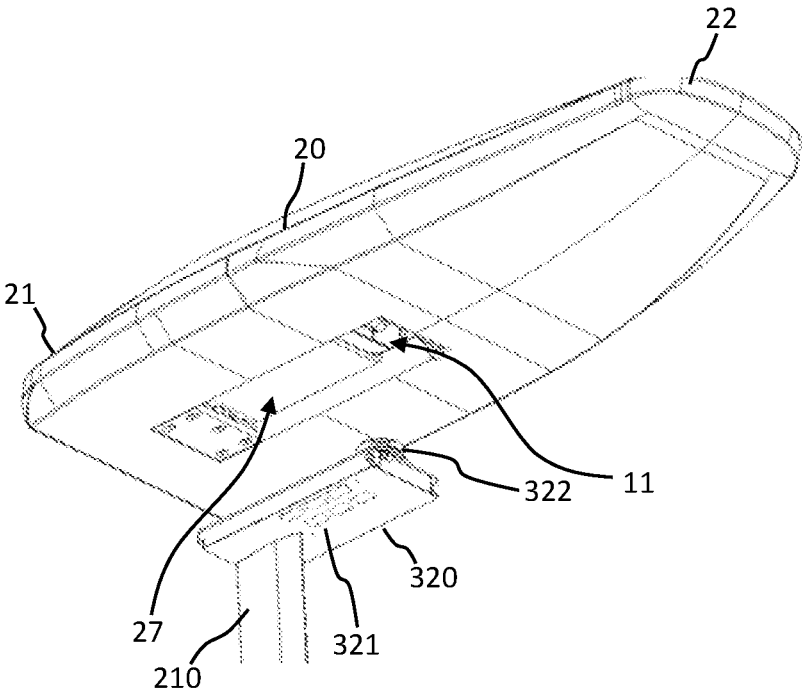
FIG. 9 depicts a bottom perspective view of a part of the modular hydrofoil watercraft according to the second embodiment.

As most clearly depicted in FIG. 9, the connector compartment 27 and the electric power unit compartment 24 may be interconnected via a through-hole 11. The through-hole 11 is adapted to receive the connector 322 such that said connector 322 is accessible from the electric power unit compartment 24. The connector compartment 27 and the electric power unit compartment 24 may overlap along the longitudinal center axis L. The connection between the electric power unit 50 and the connector part 320 may extend through the through-hole 11. Said connection may be sealed by means of sealing means such as O-rings or gaskets to form a water-tight connection. The through-hole 11 may extend substantially orthogonal to the longitudinal center axis L. The through-hole 11 may extend vertically. In one embodiment, the through-hole 11 may be further adapted to allow for passage of water from the connector compartment 27 to the electric power unit compartment 24 to cool the electric power unit 50.

The through hole 11 may be adapted to enable access to the connector part 320 from the top surface of the hull 20, thereby enabling access to the connector locking arrangement 120 from said top surface of the hull 20.

With the above described arrangement of the electric power unit compartment and connector part compartment, the electric power unit is arranged on top of the connector part which improves the stability of the watercraft since the weight of the electric power unit pushes the modules against each other mitigating the risk for undesired relative movement between the electric power unit, hull and connector part.

The watercraft according to the embodiment depicted in FIGS. 6 to 9 implements an alternative embodiment of the connector locking arrangement. Similar to the embodiments described above, the connector locking arrangement 120 may be arranged to be accessible from a top surface of the hull 20. The depicted connector locking arrangement allows for a sturdier and more robust connection between the hull and the connector part. As most clearly depicted in FIG. 7, the locking arrangement 120 may further comprise a securing member 123. The securing member 123 is movable between a securing position and a non-securing position. In the securing position, the securing member 123 is adapted to engage the locking element 122 when the locking element 122 is in the retaining position to thereby fixate the position of the locking element 122. In the non-securing position, the locking element 122 is movable between the retaining position and the disengaged position. In the depicted embodiment, the connector locking arrangement 120 comprises the securing member 123. The connector locking arrangement 120 is arranged to releasably retain the hull 20 and the connector part 320 in connection. The hull 20, e.g. the hull module, may be provided with a locking element 122 and the connector part 320 may be provided with a retention member 121. The securing member 123 is provided on the hull 20. The securing member 123 may be provided in the electric power unit compartment 24. The securing member 123 may be accessible from a top surface of the watercraft 10.

Figure 8:
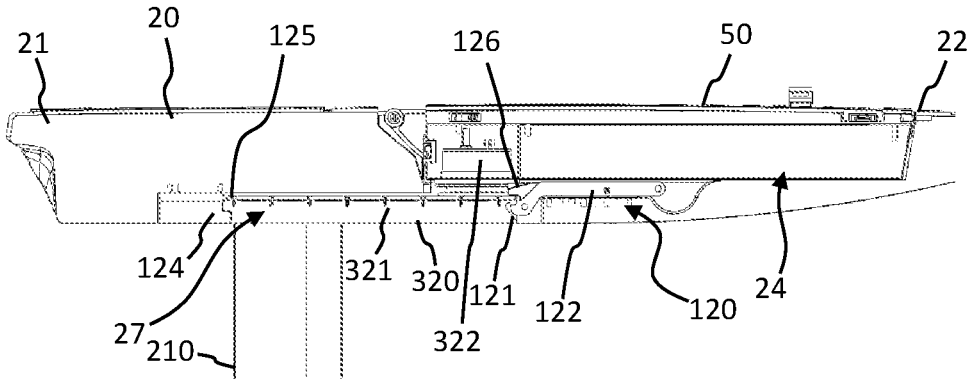
FIG. 8 depicts a cross-section view of a part of the modular hydrofoil watercraft according to the second embodiment.

As most clearly depicted in FIG. 8, one of the connector compartment 27 and the connector part 320 may comprise a retention groove 124. The other of said connector compartment 27 and the connector part 320 comprises a corresponding retention protrusion 125. The retention groove 124 and the retention protrusion 125 are arranged to engage when the connector part 320 is connected to the hull 20. Thus, the retention groove 124 and the retention protrusion 125 are arranged to come into engagement with each other when the connector part 320 is connected to the hull 20. This allows for a sturdy connection between the connector part and the hull. Preferably, the retention protrusion 125 and the retention groove 124 extend substantially orthogonally to the mast 210 and the longitudinal center axis L. In one embodiment, the connector compartment and the connector part may each comprise a plurality of retention protrusions and/or retention grooves.

Preferably, the connector locking arrangement 120 is arranged to exert a contact force pressing the retention protrusion 125 and the retention groove 124 against each other upon retaining the hull 20 and the connector part 320 when the connector part 320 is connected to the hull 20. This further increases the stability of the connection between the hull and connector part. In the depicted example, the retention portion 126 is arranged to engage the retention member 121 when the locking member 122 is in the retaining position such that the retention portion 126 pushes the retention member 121 provided on the connector part and thereby the connector part towards and preferably against the hull. Preferably, the retention portion pushes the connector part against the retention groove provided in the hull.

In one embodiment, the connector part 320 comprises a tapered surface. The tapered surface extends parallel to the longitudinal center axis L. The connector compartment 27 comprises a corresponding tapered surface. The corresponding tapered surface extends parallel and adjacent to the tapered surface of the connector part 320. Worded differently, the connector compartment 27 and the connector part 320 may each comprise a surface diagonal relative the longitudinal center axis L. The diagonal surfaces may be parallel to each other and arranged adjacent to each other when the connector part 320 is connected to, e.g. arranged in, the connector compartment 27. The diagonal interface between the connector compartment and the connector part prevents undesired relative movement between the connector compartment and the connector part. The tapered surface may be tapered in a direction extending from the rear 21 to the front 22 of the hull 20. Alternatively, the tapered surface may be tapered in a direction extending from the front 22 to the rear 21 of the hull 20.

Further referencing FIG. 8, the connector locking arrangement 120 may be arranged between the electric power unit 50 and the hull 20 when the electric power unit 50 is received in the electric power unit compartment 24. In one embodiment, the connector locking arrangement 120 may be arranged to be in contact with the bottom surface of the electric power unit 50 when the electric power unit 50 is received in the electric power unit compartment 24. Preferably, the locking element 122 is arranged to be in contact with the bottom surface of the electric power unit 50 when the electric power unit 50 is received in the electric power unit compartment 24.

According to an aspect, a modular hydrofoil watercraft according to any one of the following clauses is provided.

1. A modular hydrofoil watercraft (10) comprising a plurality of modules which are releasably connectable to each other to when assembled form said modular hydrofoil watercraft (10), wherein said modular hydrofoil watercraft (10) when assembled comprises:

a hull (20) extending along a longitudinal center axis (L);

a propulsion system (300) comprising a motor (31) and a propelling member (32), the motor (31) being in driving connection with said propelling member (32);

a mast (210) adapted to extend downwardly from the hull (20), the propelling member (32) being connected to the mast (210); and a hydrofoil (310) connected to the mast (210);

wherein the plurality of modules comprises at least a first module and second module being releasably connectable to each other, whereby the modular hydrofoil watercraft (10) further comprises one or more locking arrangements (110, 120, 130), wherein a locking arrangement (110, 120, 130) of said one or more locking arrangements (110, 120, 130) is arranged to releasably retain the first module and the second module of the plurality of modules in connection.

2. The modular hydrofoil watercraft (10) according to clause 1, wherein the plurality of modules comprises a hull module and the hull (20) is comprised in said hull module.

3. The modular hydrofoil watercraft (10) according to clause 1 or 2, wherein the hull module forms a board.

4. The modular hydrofoil watercraft (10) according to any one of the preceding clauses, wherein the locking arrangement (110, 120, 130) comprises a locking element (112, 122, 132) provided on the first module and a retention member (111, 121, 131) provided on the second module, the locking element (112, 122, 132) being movable between a retaining position in which the locking element (112, 122, 132) engages the retention member (111, 121, 131) and secures the first module to the second module and a disengaged position in which the locking element (112, 122, 132) is out of engagement with the retention member (111, 121, 131) and the first module is releasable relative the second module.

5. The modular hydrofoil watercraft (10) according to clause 4, wherein the locking arrangement (120) further comprises a securing member (123), the securing member (123) being movable between a securing position in which it is adapted to engage the locking element (122) when the locking element (122) is in the retaining position to thereby fixate the position of the locking element (122) and a non-securing position in which the locking element (122) is movable between the retaining position and the disengaged position.

6. The modular hydrofoil watercraft (10) according to clause 4 or 5, wherein the locking element (112, 122, 132) is in the form of a pivotable lock lever, wherein said pivotable lock lever comprises a retention portion (126, 136) adapted to engage the retention member (111, 121, 131) in the retaining position.

7. The modular hydrofoil watercraft (10) according to clause 4 or 5, wherein the locking element is in the form of a sliding member translationally movable between the retaining position and the disengaged position.

8. The modular hydrofoil watercraft (10) according to any one of clause 4 to 7, wherein the locking element (112, 122, 132) is adapted to exert a contact force on the second module by means of the retention member (111, 121, 131) pressing said second module against the first module when said locking element (112, 122, 132) is in the retaining position.

9. The modular hydrofoil watercraft (10) according to any one of the preceding clauses, wherein the hydrofoil (310) comprises at least one wing (312, 318) adapted to guide water flow around the hydrofoil (310).

10. The modular hydrofoil watercraft (10) according to any one of the preceding clauses, wherein the hydrofoil (310) is arranged at a bottom end of the mast (210).

11. The modular hydrofoil watercraft (10) according to any one of the preceding clauses, wherein the hydrofoil (310) is releasably connected to the mast (210).

12. The modular hydrofoil watercraft (10) according to clause 11, wherein the one or more locking arrangements (110, 120, 130) comprises a hydrofoil locking arrangement (130) arranged to releasably retain the mast (210) and the hydrofoil (310) in connection.

13. The modular hydrofoil watercraft (10) according to any one of the preceding clauses, wherein the plurality of modules comprises a hydrofoil module, said hydrofoil module comprising the hydrofoil (310).

14. The modular hydrofoil watercraft (10) according to any one of the preceding clauses, further comprising an electric power unit (50) for powering the propulsion system (300).

15. The modular hydrofoil watercraft (10) according to clause 14, wherein the plurality of modules comprises an electric power module, the electric module comprising the electric power unit (50).

16. The modular hydrofoil watercraft (10) according to clause 15, wherein the plurality of modules comprises an operation module, said operation module comprising the propulsion system (300) and the mast (210).

17. The modular hydrofoil watercraft (10) according to any one of clause 14 to 16, further comprising a connector part (320) connected to the mast (210), the connector part (320) comprising a connector (322) releasably connected to the electric power unit (50), said connector part (320) being configured to operatively couple the propulsion system (300) and the electric power unit (50).

18. The modular hydrofoil watercraft (10) according to clause 17, wherein the operation module comprises the connector part (320).

19. The modular hydrofoil watercraft (10) according to any one of the preceding clauses, further comprising a control unit (321) operatively coupled to the motor (31), said control unit (321) being configured to control said motor (31).

20. The modular hydrofoil watercraft (10) according to any one of clause 17 to 19, wherein the control unit (321) is arranged in the connector part (320).

21. The modular hydrofoil watercraft (10) according to any one of clause 17 to 20, wherein the connector part (320) is releasably connected to the hull (20).

22. The modular hydrofoil watercraft (10) according to clause 21, wherein the one or more locking arrangements (110, 120, 130) comprises a connector locking arrangement (120) arranged to releasably retain the hull (20) and the connector part (320) in connection.

23. The modular hydrofoil watercraft (10) according to clause 21 or 22, wherein the hull (20) comprises a connector compartment (27) adapted to receive the connector part (320).

24. The modular hydrofoil watercraft (10) according to clause 23, wherein one of the connector compartment (27)

and the connector part (320) comprises a retention groove (124) and the other of said connector compartment (27) and the connector part (320) comprises a corresponding retention protrusion (125), whereby the retention protrusion (124) and the retention groove (125) are arranged to engage when the connector part (320) is connected to the hull (20).

25. The modular hydrofoil watercraft (10) according to clause 23 and 24, wherein the connector locking arrangement (120) is arranged to exert a contact force pressing the retention protrusion (125) and the retention groove (124) against each other upon retaining said hull (20) and connector part (320) when the connector part (320) is connected to the hull (20).

26. The modular hydrofoil watercraft (10) according to any one of clause 23 to 25, wherein the connector part (320) comprises a tapered surface extends parallel to the longitudinal center axis (L) and the connector compartment (27) comprises a corresponding tapered surface extending parallel and adjacent to said tapered surface of the connector part (320).

27. The modular hydrofoil watercraft (10) according to any one of clause 17 to 26, further comprising connection sensing means operatively coupled to the control unit (321), said connection sensing means being configured to detect connection between the connector (322) and the electric power unit (50).

28. The modular hydrofoil watercraft (10) according to any one of clause 14 to 27, wherein the one or more locking arrangements (110, 120, 130) comprises an electric power unit locking arrangement (110) arranged to releasably retain the hull (20) and the electric power unit (50) in connection.

29. The modular hydrofoil watercraft (10) according to any one of clause 14 to 28, wherein the hull (20) comprises an electric power unit compartment (24) adapted to receive the electric power unit (50).

The invention has been described above in detail with reference to embodiments thereof. However, as is readily understood by those skilled in the art, other embodiments are equally possible within the scope of the present invention, as defined by the appended claims.

The invention claimed is:

1. A modular hydrofoil watercraft that includes a plurality of modules which are releasably connectable to each other to form the modular hydrofoil watercraft, wherein the modular hydrofoil watercraft when assembled comprises:

a hull extending along a longitudinal center axis;

a propulsion system that includes a motor and a propelling member, the motor being in driving connection with the propelling member;

a mast extending downwardly from the hull, the propelling member being connected to the mast;

a hydrofoil connected to the mast;

wherein the plurality of modules includes at least a first module and a second module being releasably connectable to each other;

one or more locking arrangements, wherein a locking arrangement of the one or more locking arrangements is arranged to releasably retain the first module and the second module of the plurality of modules in connection;

an electric power unit for powering the propulsion system, wherein the plurality of modules includes an electric power module that includes the electric power unit;

wherein the plurality of modules includes an operation module that includes the propulsion system and the mast;

a connector part connected to the mast;

wherein the connector part includes a connector releasably connected to the electric power unit;

wherein the connector part is configured to operatively couple the propulsion system and the electric power unit;

wherein the operation module includes the connector part, and wherein the connector part is releasably connected to the hull;

wherein the one or more locking arrangements includes a connector locking arrangement arranged to releasably retain the hull and the connector part in connection; and wherein the connector locking arrangement is arranged to be accessible from a top surface of the hull.

2. The modular hydrofoil watercraft according to claim 1, wherein the plurality of modules comprises a hull module and the hull is included in the hull module.

3. The modular hydrofoil watercraft according to claim 1, wherein the locking arrangement comprises a locking element provided on the first module and a retention member provided on the second module;

wherein the locking element is movable between a retaining position in which the locking element engages the retention member and secures the first module to the second module and a disengaged position in which the locking element is out of engagement with the retention member and the first module is releasable relative to the second module.

4. The modular hydrofoil watercraft according to claim 3, wherein the locking arrangement further comprises a securing member;

wherein the securing member is movable between a securing position to engage with the locking element when the locking element is in the retaining position to thereby fixate the position of the locking element and a non-securing position in which the locking element is movable between the retaining position and the disengaged position.

5. The modular hydrofoil watercraft according to claim 3, wherein the locking element is adapted to exert a contact force on the second module by means of the retention member pressing the second module against the first module when the locking element is in the retaining position.

6. The modular hydrofoil watercraft according to claim 1, wherein the plurality of modules comprises a hydrofoil module that includes the hydrofoil.

7. The modular hydrofoil watercraft according to claim 1, further comprising a control unit operatively coupled to the motor, the control unit being configured to control the motor.

8. The modular hydrofoil watercraft according to claim 1, wherein the hull comprises a connector compartment adapted to receive the connector part.

9. The modular hydrofoil watercraft according to claim 8, wherein one of the connector compartment or the connector part includes a retention groove and the other of the connector compartment or the connector part includes a corresponding retention protrusion;

wherein the retention protrusion and the retention groove engage when the connector part is connected to the hull.

10. The modular hydrofoil watercraft according to claim 9, wherein the connector locking arrangement is arranged to exert a contact force pressing the retention protrusion and the retention groove against each other upon retaining the hull and the connector part when the connector part is connected to the hull.

11. The modular hydrofoil watercraft according to claim 8, wherein the connector part includes a tapered surface extending parallel to the longitudinal center axis; and wherein the connector compartment includes a corresponding tapered surface extending parallel and adjacent to the tapered surface of the connector part.

12. The modular hydrofoil watercraft according to claim 7, further comprising connection sensing means operatively coupled to the control unit;

wherein the connection sensing means is configured to detect connection between the connector and the electric power unit.

13. The modular hydrofoil watercraft according to claim 1, wherein the hull comprises an electric power unit compartment adapted to receive the electric power unit.

* * * * *